United States Patent [19]

Singer

[11] Patent Number: 4,466,599

[45] Date of Patent: Aug. 21, 1984

[54] LIFTING DEVICE, IN PARTICULAR, A TACKLE BLOCK

[76] Inventor: Edouard Singer, 53 Rue de Mulhouse, 68790 Morschwiller-le-Bas, France

[21] Appl. No.: 320,941

[22] Filed: Nov. 13, 1981

[30] Foreign Application Priority Data

Nov. 19, 1980 [FR] France ..... 80 24713

[51] Int. Cl.[3] ..... B66D 3/10

[52] U.S. Cl. ..... 254/391; 254/403

[58] Field of Search ..... 254/391, 393, 403, 411

[56] References Cited

U.S. PATENT DOCUMENTS

| | | | |
|---|---|---|---|
| 1,130,713 | 3/1915 | Daly et al. | 254/411 X |
| 4,264,056 | 4/1981 | Singer | 254/391 |
| 4,332,372 | 6/1982 | Singer | 254/391 |

*Primary Examiner*—John M. Jillions

*Attorney, Agent, or Firm*—Darby & Darby

[57] ABSTRACT

A tackle block for a cord having a rotatable pulley mounted on a shaft between a pair of legs, there being first and second pulleys mounted on a part of the shaft which is exterior of said legs. A guide sheath formed of a pair of arms is associated with the first pulley and the space between each of the arms and the groove of the first pulley is a minimum necessary for a cord of a certain diameter. The second fixed pulley has its inner plate slidably mounted on the shaft and resiliently biased toward said inner plate, with the inner plate being formed of a material which presents a large amount of friction to the cord. A guide means in the form of a pair of arms, each having a notch is provided on the outer face of the movable plate of the second fixed pulley to lock the cord. A braking shoe is mounted in a movable manner below the rotatable pulley to engage the rotatable pulley.

9 Claims, 4 Drawing Figures

LIFTING DEVICE, IN PARTICULAR, A TACKLE BLOCK

The invention pertains to a lifting device, in particular, a tackle block.

French Pat. No. 2,398,690 teaches a lifting device, in particular a tackle block formed by a strap provided at the top thereof with a hooking member, a shaft and a pulley, mobile on this shaft and placed between the two legs of the strap. The shaft has at least one fixed pulley disposed outside the strap and is able to cooperate, when used as a lowering or a hoisting device, with the mobile pulley, by means of notches formed in the leg of the strap interposed between the mobile pulley and the fixed pulley or pulleys, and permitting the passage of the cord. The fixed pulley has a conical internal flank, whose large base is situated on the side toward the outer perimeter of the fixed pulley, and whose small base is situated on the side toward the hub. This device has a cover made of an elastomer, threaded over the fixed shaft and applying against the fixed pulley. The cover, of circular shape, has a flange directed toward the vertical leg of the strap. This flange insures the maintenance of the cord on the fixed pulley.

French Pat. No. 2,456,704, teaches improvements made in the lifting device cited above, consisting of a shoe mounted on a sliding plate and cooperating with the mobile pulley to immobilize the latter. This shoe, made of a non-skid material, has, at the top thereof, a semitoric boss which, under the influence of the force applied on the cord, penetrates into the groove of the mobile pulley. This shoe has a bottom portion in the shape of a half-pulley provided with a groove adapted to the cord used.

Other improvements, known from French Pat. No. 2,476,050 were imparted to the above lifting device. These improvements are that the second fixed pulley has two cheekplates with variable spacing, one of which is integral with the outer face of the cover applied against the first fixed pulley, and the other, sliding on the shaft, is returned elastically to nip the free strand of the cord betwen the two cheekplates. Each cheekplate has a frusto-conical flank, abutting on the one hand on the outer perimeter of the cheekplate, and, on the other hand, on an opposing shoulder, applying one against the other. The mobile cheekplate has a recess formed in outer face thereof, in which an elastic element is placed, insuring the elastic return of the mobile cheekplate to apply it against the fixed cheekplate.

Owing to the fact that a human life often depends on the proper operation of the device, the present invention is intended to improve the safety of the device.

The invention solves the problem on the one hand, eliminates slip of the cord which may have been merely placed in the groove of the second fixed pulley by the user, without being wedged therein, while making a wrong movement of the cord impossible. On the other hand, it prevents the hand of the user, from being drawn by the cord and pinched between the cord and the base of the groove of the second fixed pulley.

The invention is set forth in more detail below, with the aid of drawings representing only one means of execution.

IN THE DRAWINGS

FIG. 1 is a fragmentary sectional view of a device according to the invention taken along line I—I in FIG. 2;

FIG. 1*a* is a view corresponding to FIG. 1 showing a portion of the structure thereof on a larger scale;

Figure 3:
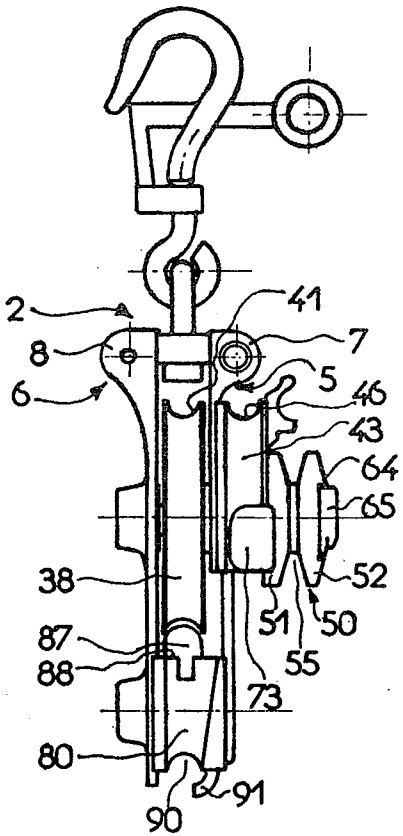
FIG. 3 represents a mirror image of FIG. 1, relative to line I—I in FIG. 2.
Figure 2:
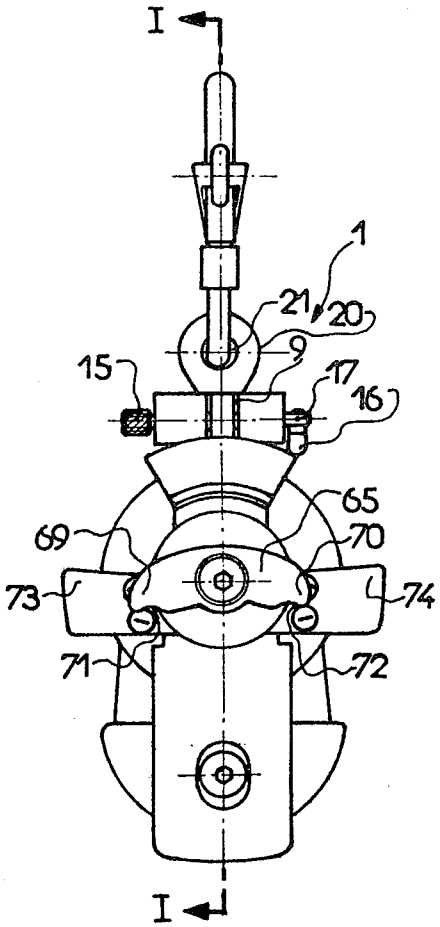
FIG. 2 represents an elevational view of the lifting device according to the invention.
Figure 1:
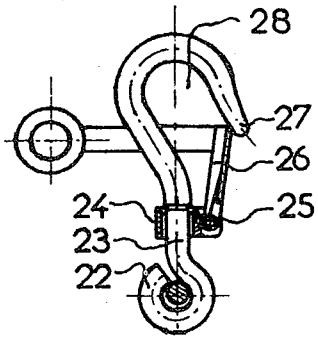
Figure 1A:
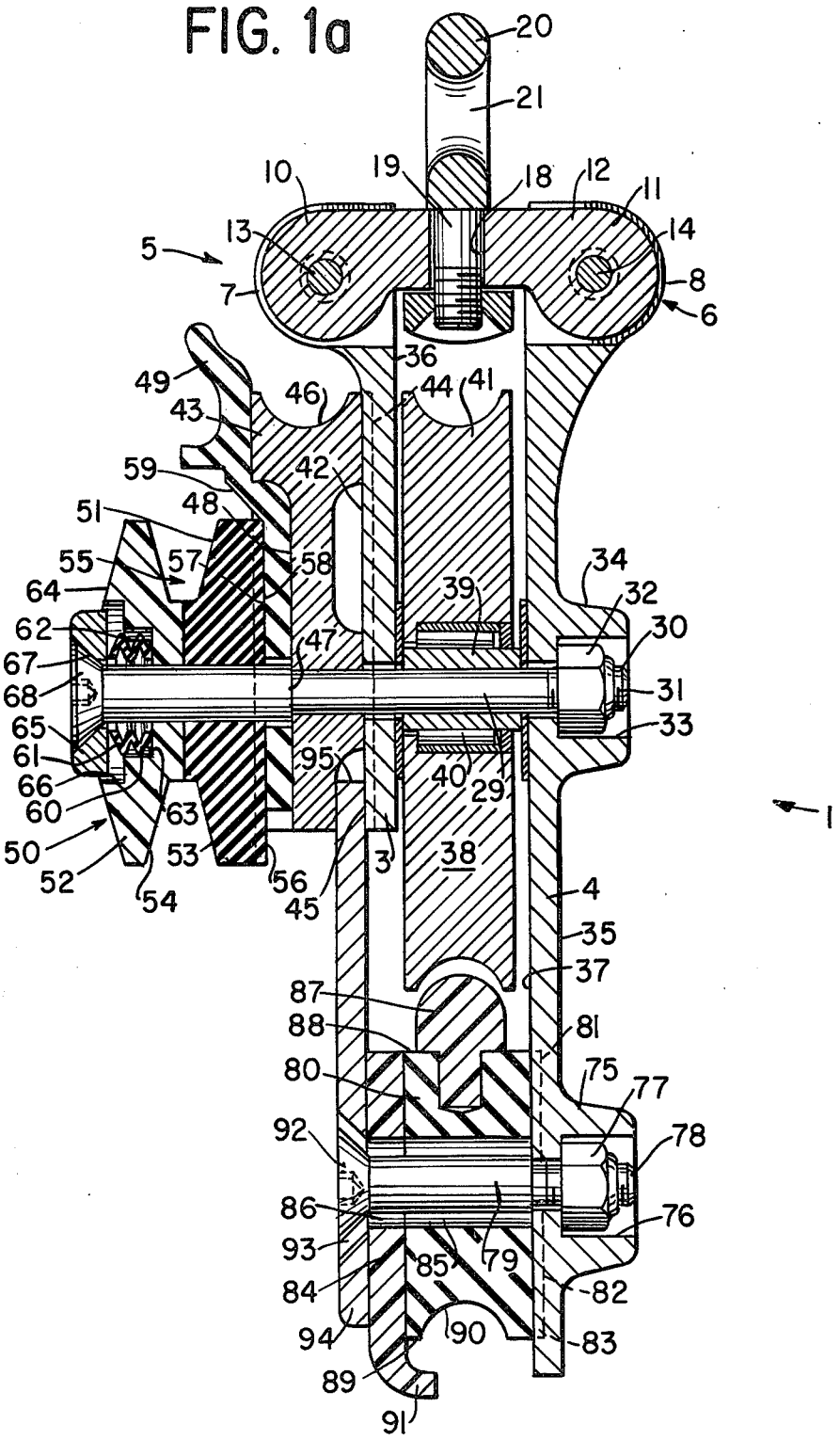

Reference will be made to the four figures.

The lifting device, in particular the tackle block 1 includes a strap 2 formed of two vertical legs 3, 4. The upper end 5, 6 thereof includes a head 7, 8 in which a transverse channel 9 is formed. In this channel 9 there is lodged, the end 10, 11, of a crosspiece 12 held by shafts 13, 14, one end of the ends of which is provided with a head 15, and the other end thereof exhibits a locking element 16 pivoting around an axis of articulation 17.

In crosspiece 12 a vertical hole 18 is made, serving for passage of shaft 19 of an eye 20. The latter has an orifice 21 in which is engaged the curved lower end 22 of a hook 23. On this hook 23 is threaded a bushing 24 traversed by a shaft 25 forming the link between the said bushing 24 and a locking element 26. The latter cooperates with the tip 27 of hook 23 to prevent the cord from emerging from loop 28 of the said hook 23.

The two vertical legs 3, 4 are traversed by a horizontal shaft 29 whereof one end 30 is provided with a thread 31, on which is screwed a nut 32 lodged in a recess 33 formed in a boss 34 integral with the outer face 35 of the vertical leg 4.

Between the inner faces 36, 37 of the two vertical legs 3, 4 a rotatable pulley 38 is disposed, placed over a bushing 39 which is in turn threaded on the horizontal shaft 29. Between bushing 39, which is fixed in rotation, and rotatable pulley 38, a needle bearing 40 is inserted. This rotatable pulley 38 has a groove 41 for the cord (not shown).

On the outer face 42 of the other vertical leg 3, a first fixed pulley 43 is attached, whereof the face directed toward vertical leg 3 has a tongue 44 threaded in a channel 45 formed in outer face 42 of vertical leg 3. As a result, the first fixed pulley 43 cannot pivot around horizontal shaft 29 passing through the said fixed pulley 43 from side to side. The latter has a semitoric groove 46 in which the cord is placed. Fixed pulley 43 is held applied against the outer face 42 of vertical leg 3 by a shoulder 47 of horizontal shaft 29.

Against the outer face 48 of the first fixed pulley 43, there rests a cover 49 of an elastomer material serving as an element of separation between the first fixed pulley 43 and a second fixed pulley 50. This second fixed pulley 50 is likewise mounted on horizontal shaft 29. This second fixed pulley 50 has two cheekplates 51, 52, forming locking means for the cord. According to the invention, the outer one of these cheekplates 52 is made of polyester reinforced with glass fibers, while the inner one 51 is made of hard rubber. The inner profile 53, 54 of the two cheekplates 51, 52 is in the form of a trapezoidal groove 55. Cheekplate 51, closest to the elastomer cover 49, is fixed, and is integrated with the said cover 49 by means of a tongue 56 projecting relative to the face 57 of cheekplate 51, this tongue 56 being lodged in a channel 58 formed in the outer face 59 of cover 49. The second cheekplate 52 slides on the horizontal shaft 29, and it is kept applied against cheekplate 51 by the action of elastic elements 60, 61. These elastic elements 60, 61, placed on horizontal shaft 29, are held between the base 62 of a recess 63 formed in the outer face 64 of sliding cheekplate 52, and a guide 65 sliding in a set-back 66 terminating at recess 63. This guide 65 has a milled hole 67 in which is embedded the head 68 of horizontal shaft 29. In the trapezoidal groove 55, a synthetic cord can be self-locked under the influence of the traction of the weight suspended from the opposite strand.

In the event the cord is merely laid in groove 55, without being wedged therein, the slip is practically zero, owing to the cheekplate 51 of non-skid rubber, for the slightest traction on the opposite strand, a vigorous and instantaneous self-locking will take place. In no case can the cord slip through.

Guide 65, preferably of cast aluminum, is mounted on the outer face 64 of sliding cheekplate 52 of the second fixed pulley 50 and has two legs 69, 70, each provided with a respective notch 71, 72. These two legs 69, 70 can lodge in the set-back 66 in recess 63. This guide 65 obliges the user, at the moment the cord is unblocked, to maneuver the cord in the plane of winding of the cord. If at the moment of the maneuver, the user tended to draw the cord toward himself, i.e. in a vertical position relative to the second fixed pulley 50, the cord would automatically slip into a notch 71, 72, and in no case could it slide through out of control.

On the outer face 48 of the first fixed pulley 43, two guides 73, 74 are fixed, which are preferably made of aluminum. These two guides 73, 74, with the semitoric groove 46 of the first fixed pulley 43, form a guide sheath for the cord, with the minimum opening necessary for the passage of a cord of a given diameter.

At the moment of unblocking, there is a slip of the cord under the influence of the weight attached to the opposite strand. The hand of the user, entrained by the cord, will be held back by one of the guides 73, 74, thereby preventing the hand from being pinched between the cord and the base of semitoric groove 46.

On the other hand, tackle block 1 can be made to execute a pendular movement at the moment when the weight attached to the opposite strand of the cord is pushed into position of descent. The cord, in spite of accidental thrust and twists, remains in the guide sheath formed by the two guides 73, 74 and the base of the semitoric groove 46 of the first fixed pulley 43. In no case can the cord emerge from the braking system described below.

The outer face 35 of vertical leg 4 has a second boss 75 in which a recess 76 is formed, to serve as a lodging for a nut 77 screwed on the threaded end 78 of a lower horizontal shaft 79. On this horizontal shaft 79 is threaded a braking shoe 80, whereof one of the outer faces 81 has a tongue 82 engaged in a channel 83 formed in the inner face 37 of the vertical leg. Braking shoe 80, made of a non-skid material such as rubber, is mounted on a glass-fiber plate 84. The glass-fiber plate 84 and the braking shoe 80 have vertical openings 85, 86 providing passage for horizontal shaft 79. These openings 85, 86 permit the vertical displacement of plate 84 and braking shoe 80. In the course of this vertical displacement due to the action of the force applied to the cord, a semitoric boss 87, integral with the upper part 88 of braking shoe 80, engages in groove 41 of rotatable pulley 38. At the bottom 89 thereof, the braking shoe 80 has a groove 90 adapted to the cord used which, in turn, is held in this groove by the curved end 91 of plate 84.

The cord extends from the weight to be supported around the top of the rotatable pulley 38, then around the bottom of the braking shoe 80, then around the top of the fixed pulley 43 on the inside of fixed guides 73 and 74, and finally around the second fixed pulley 50 between the guides 73, 74 and legs 69, 70 of the guide 65.

The head 92 of horizontal shaft 79 slides in a milled opening 93 formed in a stop plate 94 whereof the upper end 95 is wedged between the first fixed pulley 43 and the outer face 42 of vertical leg 3.

It should be apparent that the present invention may take a variety of alternative forms and that the foregoing description is merely illustrative. Accordingly, the scope of protection afforded the present invention is defined by the annexed claims.

What is claimed is:

1. A tackle block for use with a cord comprising
- a strap having two legs,
- a shaft fixedly mounted between said two legs and having a portion extending outwardly of one of said legs,
- a pulley mounted for rotation on said shaft between said strap legs,
- a first pulley fixedly mounted on said extending portion of said shaft,
- a second pulley mounted on said extending portion of said shaft outwardly of said first pulley, said second pulley formed by two cheekplates, one of said cheekplates being slidable along said shaft,
- a braking shoe, means for mounting said braking shoe spaced from said rotatable pulley to move slidably relative to said shaft on which said rotatable pulley is mounted to cooperate with said rotatable pulley,
- a sheath extending outwardly of said first fixed pulley for guiding the cord therebetween, and
- cooperating locking means and guide means on said second fixed pulley for the free strand of the cord, said guide means being separate from and movably mounted with respect to said second fixed pulley.

2. A tackle block as in claim 1 further comprising a cover of elastomeric material between said first and second fixed pulleys.

3. A tackle block as in claim 1 wherein said first fixed pulley has a groove to accept the cord, said guide sheath comprising two members integral with the outer face of said first fixed pulley, the space between the guide sheath and the groove of said first fixed pulley being the minimum necessary for the passage of a cord of given diameter.

4. A tackle block as in claim 3 wherein the groove of said first fixed pulley is semitoric in shape.

5. A tackle block as in claim 1 wherein said locking means comprise said two cheekplates of said second fixed pulley.

6. A tackle block as in claim 5 wherein the outer cheekplate is of a polyester material reinforced with glass fiber and the inner cheekplate is of hard rubber.

7. A tackle block as in either of claims 5 or 6 wherein said inner cheekplate is fixed relative to said shaft and said outer cheekplate slides on said shaft.

8. A tackle block as in claim 7 further comprising means for biasing said outer cheekplate toward said inner cheekplate.

9. A tackle block for use with a cord comprising
- a strap having two legs,
- a shaft fixedly mounted between said two legs and having a portion extending outwardly of one of said legs, a pulley mounted for rotation on said shaft between said strap legs, a first pulley fixedly mounted on said extending portion of said shaft, a second pulley mounted on said extending portion of said shaft outwardly of said first pulley, said second pulley formed by two cheekplates, one of said cheekplates being slidable along said shaft, a braking shoe, means for mounting said braking shoe spaced from said rotatable pulley to move slidably relative to said shaft on which said rotatable pulley is mounted to cooperate therewith, a sheath extending outwardly of said first fixed pulley for guiding the cord therebetween, and cooperating locking means and guide means on said second fixed pulley for the free strand of the cord, wherein said guide means of said second fixed pulley comprises a pair of legs on the outer face of said outer cheekplate each provided with a respective notch, a recess formed in said outer cheekplate having a set back therein and cooperating with the notch on a respective leg of said guide means to lock the cord therebetween.

* * * * *